US006787203B2

(12) United States Patent
Hiroishi et al.

(10) Patent No.: US 6,787,203 B2
(45) Date of Patent: Sep. 7, 2004

(54) THERMAL TRANSFER RECORDING MEDIUM

(75) Inventors: Katsunori Hiroishi, Tokyo (JP); Keiichi Shiokawa, Tokyo (JP); Takayuki Sasaki, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 43 days.

(21) Appl. No.: 10/223,421

(22) Filed: Aug. 20, 2002

(65) Prior Publication Data

US 2003/0054144 A1 Mar. 20, 2003

(30) Foreign Application Priority Data

Aug. 20, 2001 (JP) ..... 2001-249694

(51) Int. Cl.[7] ..... B41M 5/40

(52) U.S. Cl. ..... 428/32.72; 428/32.82; 428/32.87

(58) Field of Search ..... 428/32.72, 32.82, 428/32.87

(56) References Cited

U.S. PATENT DOCUMENTS

| | | | | |
|---|---|---|---|---|
| 4,833,021 A | | 5/1989 | Shimura et al. | 428/32.79 |
| 4,983,446 A | | 1/1991 | Taniguchi et al. | 428/32.8 |
| 5,134,019 A | | 7/1992 | Shiokawa et al. | 428/32.62 |
| 5,179,388 A | | 1/1993 | Shiokawa et al. | 347/171 |
| 5,183,697 A | | 2/1993 | Ide et al. | 428/32.62 |
| 5,238,726 A | | 8/1993 | Ide et al. | 428/484.1 |
| 5,324,585 A | | 6/1994 | Akiyama et al. | 428/32.39 |
| 5,328,747 A | | 7/1994 | Ide et al. | 428/32.62 |
| 5,336,548 A | | 8/1994 | Shiokawa et al. | 428/32.7 |
| 5,409,758 A | | 4/1995 | Hiyoshi et al. | 428/32.62 |
| 5,428,372 A | | 6/1995 | Akiyama et al. | 347/217 |
| 5,482,911 A | | 1/1996 | Hiroishi et al. | 503/200 |
| 5,773,153 A | | 6/1998 | Shiokawa et al. | 428/32.68 |
| 5,800,914 A | | 9/1998 | Shiokawa et al. | 428/32.8 |
| 5,952,103 A | | 9/1999 | Shiokawa et al. | 428/32.68 |
| 6,077,594 A | | 6/2000 | Roth | 428/32.84 |
| 6,150,008 A | * | 11/2000 | Nakayama et al. | 428/195.1 |
| 6,210,794 B1 | * | 4/2001 | Nakamura | 428/32.79 |
| 6,231,964 B1 | | 5/2001 | Miller, Jr. et al. | 428/32.7 |
| 6,391,466 B1 | * | 5/2002 | Sogabe et al. | 428/32.82 |

FOREIGN PATENT DOCUMENTS

| | | |
|---|---|---|
| JP | 63-051182 | 3/1988 |
| JP | 10-129122 | 5/1998 |
| JP | 2001-171233 | 6/2001 |

* cited by examiner

*Primary Examiner*—B. Shewareged
(74) *Attorney, Agent, or Firm*—Oblon, Spivak, McClelland, Maier & Neustadt, P.C.

(57) ABSTRACT

A thermal transfer recording medium including at least a substrate; a separation layer located overlying the substrate; and an ink layer located overlying the separation layer, wherein the separation layer includes at least a wax including a polyethylene wax, and wherein the ink layer includes at least a thermoplastic saturated polyester resin having a hydroxyl value of from 20 to 60 mgKOH/g; and an oxidized polyethylene having an acid value not greater than 5 mgKOH/g.

17 Claims, No Drawings

THERMAL TRANSFER RECORDING MEDIUM

BACKGROUND OF THE INVENTION

1. Field of the Invention

The present invention relates to a thermally melted transfer recording medium, and more particularly to a thermal transfer recording medium producing high-resolution and solvent-resistant images.

2. Discussion of the Background

The thermally melted transfer recording medium is required to produce high-resolution images. Further, the produced images are required not to be erased with organic solvents such as ethanol, depending on the use environment.

In order to obtain good transferability, a method using a specific polyester resin as a thermally melted binder is disclosed. Japanese Laid-Open Patent Publication No. 63-51182 discloses a method using a polyester resin having a hydroxyl value of from 18 to 260. However, a thermal transfer recording medium produced by this method has good transferability, but durability of the resultant images, such as solvent resistance, is not satisfactory.

In addition, Japanese Laid-Open Patent Publication No. 2001-171233 discloses a method using a polyester having a specified solvent solubility. Japanese Laid-Open Patent Publication No. 10-129122discloses a method using a resin having a specified solubility and a parameter, and including acid-modified polyethylene into an ink. However, any of these methods do not produce a thermal transfer recording medium producing high-resolution and solvent-resistant images. Particularly, in a hedge-type thermal head printer, since a distance from a heating element to a point where a thermal transfer recording medium and a receiving material separate from each other is extremely short, and a printing speed is high, a time from application of energy to the separation is short. Therefore, an ink is not sufficiently fixed on the receiving material and it is difficult to produce images having good solvent resistance. A thermal transfer recording medium producing high-resolution and solvent-resistant images, which can be used in such a hedge-type thermal head printer is not available.

Because of these reasons, a need exists for a thermal transfer recording medium producing high-resolution and solvent-resistant images.

SUMMARY OF THE INVENTION

Accordingly, an object of the present invention is to provide a thermal transfer recording medium producing high-resolution and solvent-resistant images.

Briefly this object and other objects of the present invention as hereinafter will become more readily apparent can be attained by a thermal transfer recording medium including at least a substrate; a separation layer located overlying the substrate; and an ink layer located overlying the separation layer, wherein the separation layer includes at least a wax including a polyethylene wax, and wherein the ink layer includes at least a thermoplastic saturated polyester resin having a hydroxyl value of from 20 to 60 mgKOH/g; and an oxidized polyethylene having an acid value not greater than 5 mgKOH/g.

The polyethylene wax preferably has a melting point of from 100 to 120° C. and a penetration less than 2 dmm at 25° C.; the separation layer preferably further includes an ethylene-vinyl acetate copolymer resin and a carnauba wax and/or a candelilla wax; and the thermoplastic saturated polyester resin is preferably a reaction product of a dicarboxylic acid compound with a glycol compound, wherein the dicarboxylic acid compound includes at least an aromatic dicarboxylic acid.

DETAILED DESCRIPTION OF THE INVENTION

Generally, the present invention provides a thermal transfer recording medium producing high-resolution and solvent-resistant images.

As mentioned above, the thermal transfer recording medium of the present invention is characterized by including at least a substrate; a separation layer located overlying the substrate; and an ink layer located overlying the separation layer, wherein the separation layer includes at least a wax including a polyethylene wax, and wherein the ink layer includes at least a thermoplastic saturated polyester resin having a hydroxyl value of from 20 to 60 mgKOH/g; and an oxidized polyethylene having an acid value not greater than 5 mgKOH/g.

A thermal transfer recording medium having such a composition produces images having high solvent resistance as well as high resolution.

The thermoplastic saturated polyester resin for use in the present invention has a hydroxyl value of from 2 to 60 mgKOH/g. When the hydroxyl value is less than 20 mgKOH/g, the resultant thermal transfer recording medium does not have sufficient heat sensitivity and does not produce high resolution images regardless of an acid value of the mixed oxidized polyethylene. When greater than 60 mgKOH/g, the solvent resistance deteriorates. The thermoplastic saturated polyester resin of the present invention is preferably a product synthesized by a glycol compound and a dicarboxylic acid compound. Specific examples of the glycol compound include ethylene glycol, propanediol, 1,4-butanediol, 1,6-hexanediol, diethylene glycol, neopentyl glycol, polyethylene glycol, polytetramethylene glycol, trimethylolpropane, adducts of bisphenol A with an ethylene oxide, etc. Specific examples of the dicarboxylic acid compound include terephthalic acid, isophthalic acid, orthophthalic acid, 2,6-naphthalenedicarboxylic acid, paraphenylenedicarboxylic acid, succinic acid, glutaric acid, adipic acid, suberic acid, azelaic acid, sebacic acid, dodecanedionic acid, trimellitic acid, pyromellitic acid, etc. In the present invention, it is more preferable to use at least an aromatic dicarboxylic acid such as a terephthalic acid and an isophthalic acid as the dicarboxylic acid because the resultant thermal transfer recording medium produces images having good solvent resistance.

The thermoplastic saturated polyester resin of the present invention preferably has a glass transition temperature of from 10 to 55° C., and preferably from 30 to 50° C., and a number-average molecular weight of from 500 to 6,000, preferably from 1,000 to 2,500. When the glass transition temperature is less than 10° C. or the number-average molecular weight is less than 500, the resultant thermal transfer recording medium produces images having deteriorated solvent resistance and blocking of the thermal transfer recording medium tends to occur. When the glass transition temperature is greater than 55° C. or the number-average molecular weight greater than 6,000, the resultant thermal transfer recording medium has deteriorated heat sensitivity and produces deteriorated resolution images.

In addition, the thermal transfer recording medium of the present invention includes an oxidized polyethylene having an acid value not greater than 5 mgKOH/g as well as the thermoplastic saturated polyester resin. When the acid value is greater than 5 mgKOH/g, the resultant thermal transfer recording medium produces images having deteriorated solvent resistance. When the ink layer of the thermal transfer recording medium does not include a thermoplastic saturated polyester resin having a hydroxyl value of from 20 to 60 mgKOH/g, the fixability of the ink layer onto a receiving material deteriorates and the resultant thermal transfer recording medium produces images having deteriorated solvent resistance. In addition, when the ink layer does not include an oxidized polyethylene having an acid value not greater than 5 mgKOH/g, the ink layer has deteriorated solvent resistance and the resultant thermal transfer recording medium produces images having deteriorated solvent resistance. Due to a synergistic effect of the oxidized polyethylene having an acid value not greater than 5 mgKOH/g and the thermoplastic saturated polyester resin having a hydroxyl value of from 20 to 60 mgKOH/g, the resultant thermal transfer recording medium produces high solvent-resistant images. This combination is particularly effective for low-energy printing. The oxidized polyethylene included in the ink layer preferably is a particulate substance having a particle diameter of from 0.1 to 10 $\mu$m, and more preferably from 0.5 to 8 $\mu$m. When greater than 10 $\mu$m, the resultant thermal transfer recording medium produces deteriorated resolution images.

The thermoplastic saturated polyester resin having a hydroxyl value of from 20 to 60 mgKOH/g is preferably included in the ink layer in an amount of from 40 to 80% by weight, and more preferably from 50 to 70% by weight. When less than 40% by weight, the resultant thermal transfer recording medium produces images having deteriorated solvent resistance. When greater than 80% by weight, the resultant thermal transfer recording medium produces deteriorated resolution images. In addition, the oxidized polyethylene having an acid value not greater than 5 mgKOH/g is preferably included in the ink layer in an amount of from 5 to 15% by weight, preferably from 8 to 12% by weight. When less than 5% by weight, the resultant thermal transfer recording medium produces images having deteriorated solvent resistance. When greater than 15% by weight, the resultant thermal transfer recording medium produces deteriorated resolution images.

The separation layer of the present invention includes a polyethylene wax, which preferably has a melting point of from 100 to 120° C. when measured by a ASTM D127 test method. When less than 100° C., the resultant thermal transfer recording medium produces deteriorated resolution images. When greater than 120° C., the resultant thermal transfer recording medium has deteriorated heat sensitivity. Further, the polyethylene wax preferably has a penetration less than 2 dmm at 25° C. when measured by a ASTM D1321 test method. When not less than 2dmm, the resultant thermal transfer recording medium produces images having deteriorated solvent resistance. In addition, the polyethylene wax preferably includes high-density polyethylene having a density not less than 0.94, preferably not less than 0.96.

A polyethylene wax relatively has a high melting point, and when it is included in the separation layer, the resultant thermal transfer recording medium produces sharp images having high resolution without a blur, but has a drawback that the heat resistance deteriorates. However, since the ink layer of the present invention includes the thermoplastic saturated polyester resin having a hydroxyl value of from 20 to 60 mgKOH/g, the resultant thermal transfer recording medium produces images having good fixability and has good heat sensitivity. Therefore, a combination of the separation layer and the ink layer of the present invention can highly satisfy the heat sensitivity, high-resolution and solvent-resistant image producibility of the resultant thermal transfer recording medium.

Specific examples of a binder for use in the separation layer of the present invention include an ethylene-vinylacetate copolymer resin, a polyamide resin, a polyester resin, an isoprene rubber, a butadiene rubber, an ethylenepropylene rubber, a butyl rubber, a nitrile rubber, etc. Among these binders, it is preferable to use the ethylene-vinylacetate copolymer resin. Further, the ethylene-vinylacetate copolymer resin preferably includes vinyl acetate units in an amount of from 15 to 35% by weight, preferably from 25 to 35% by weight, when measured by a saponifying method and has a melt flow rate of from 10 to 200 dg/min, preferably from 10 to 100 dg/min, when measured by an altered ASTMD-1238method, to produce high-resolution images.

A wax besides the polyethylene wax can be included in the separation layer of the present invention. Specific examples of the wax include a natural wax such as a bees wax, a whale wax, a Japan wax, a rice wax, a carnauba wax, a candelilla wax and a montan wax; a synthesized wax such as a microcrystalline wax, an acid wax, an ozokerite, a ceresin and an ester wax; a higher saturated fatty acid such as an margaric acid, a lauric acid, a myristic acid, a palmitic acid, a stearic acid, a Freund acid and a behenic acid; a higher saturated univalent alcohol such as a stearyl alcohol and a behenyl alcohol; a higher ester such as a fatty acid ester of sorbitan; a higher fatty acid amide such as a stearic amide and an oleic amide, etc. Among these waxes, the carnauba wax or the candelilla wax are preferably used to improve the heat sensitivity of the resultant thermal transfer recording medium. When these waxes besides the polyethylene wax are included in the separation layer, a content thereof is preferably not greater than 50% by weight based on total weight of the waxes included in the separation layer.

Various additives may be included in the ink layer of the present invention for the purpose of improving the heat sensitivity and high-resolution image producibility of the resultant thermal transfer recording medium. For example, a waxy fatty acid amide, various lubricants, synthesized waxes such as a paraffin wax, natural waxes such a candelilla wax and a carnauba wax and oils such as an silicone oil and perfluoroalkylether can be included to improve the heat sensitivity and high-resolution image producibility of the resultant thermal transfer recording medium. Specific examples of the lubricants include phosphate esters; resins such as a silicone resin, an ethylene tetrafluoride resin and a fluoroalkylether resin; and inorganic lubricants such as silicon carbonate and a silica.

As the colorant for use in the ink layer of the present invention, carbon black, organic pigments, inorganic pigments or various dyes can be used according to a required color tone.

As the substrate of the present invention, known films and papers can be used. For example, plastic films relatively having a high heat resistance, such as polyester like polyethyleneterephthalate, polycarbonate, triacetylcellulose, nylon and polyimide; cellophane; a parchment paper, etc. are preferably used.

In addition, a protection layer may be optionally formed on a backside of the substrate of the thermal transfer recording medium of the present invention. The protection layer is formed to protect the substrate from a high temperature when a heat is applied thereto by a thermal head. A heat resistant thermoplastic resin and a thermosetting resin, an ultraviolet curing resin and an electron beam curing resin can be used to form the protection layer. In addition, a thin film of a fluorocarbon resin, a silicone resin, a polyimide resin, an epoxy resin, a phenol resin, a melamine resin, etc. are preferably used to form the protection layer. In addition, since the protection layer can remarkably improve heat resistance of a substrate, materials which have been unsuitable for a substrate can be used if the protection layer is formed thereon.

A thermal transfer layer including the above-mentioned separation layer and ink layer can be formed on the substrate by a hot melt coating method, an aqueos coating method, a method using an organic solvent, etc. The thermal transfer layer formed by such methods preferably has a thickness of from 0.1 to 10 μm, and more preferably from 0.5 to 6.0 μm. In addition, the ink layer preferably has a thickness of from 0.5 to 6.0 μm, and more preferably from 0.8 to 3.0 μm. The separation layer preferably has a thickness of from 0.2 to 3.0 μm, and more preferably from 1.0 to 2.0 μm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following Examples and Comparative Examples, the thermoplastic saturated polyester resin used is a polycondensate of terephthalic acid, ethylene glycol, isophthalic acid and neopentylglycol.

The following Table 1 sets forth the particle diameter (A) of the oxidized polyethylene and the density (B) of the polyethylene wax used in each of the Examples and Comparative Examples.

TABLE 1

| | (A) μm ※ | (B) (—) |
|---|---|---|
| Example 1 | 7 | 0.94 |
| Example 2 | 7 | 0.94 |
| Example 3 | 7 | 0.94 |
| Example 4 | 7 | 0.94 |
| Example 5 | 7 | 0.96 |
| Example 6 | 7 | 0.94 |
| Example 7 | 7 | 0.94 |
| Comparative Example 1 | 7 | 0.94 |
| Comparative Example 2 | 7 | — |
| Comparative Example 3 | 7 | — |
| Comparative Example 4 | 7 | 0.94 |
| Comparative Example 5 | 7 | 0.94 |
| Comparative Example 6 | 7 | 0.94 |

※ Median diameter measured by a particle diameter distribution measurer LA-920 from HORIBA, LTD.

Example 1

A polyethyleneterephthalate film having a thickness of 4.5 μm was prepared as a substrate. A silicone rubber (SD7226 from Dow Corning Toray Silicone Co., Ltd.) was coated on an opposite side of the substrate to a side on which a thermal transfer recording layer is formed, and dried so as to have a coated amount of 0.2 g/m$^2$ form a substrate having a heat resistant lubricated layer.

Separation Layer Formulation

A separation layer liquid having the following formulation was coated on a thermal-transfer-recording layer side of the substrate and dried so as to have a thickness of about 1.0 μm to form a separation layer.

| | |
|---|---|
| Toluene dispersion liquid of a polyethylene wax having a melting point of 96° C. and a penetration of 6 dmm (a solid content of 10%) | 90 |
| Toluene liquid solution of an ethylene-vinylacetate copolymer resin (a solid content of 10%) | 10 |

Ink Layer Formulation

An ink layer liquid having the following formulation was coated on the above-mentioned separation layer and dried so as to have a thickness of about 1.0 μm to form an ink layer.

| | |
|---|---|
| MEK liquid solution of a polyester resin having a hydroxyl value of 25 mgKOH/g (a solid content of 20%) | 60 |
| MEK dispersion liquid of an oxidized polyethylene having an acid value of 5 mgKOH/g (a solid content of 20%) | 7 |
| MEK dispersion liquid of carbon black (a solid content of 20%) | 33 |

Thus, a thermal transfer recording medium was prepared.

Example 2

The procedures of preparation for the thermal transfer recording medium in Example 1 were repeated to prepare a thermal transfer recording medium except for using a polyester resin having a hydroxyl value of 60 mgKOH/g instead of 25 mgKOH/g in the ink layer.

Example 3

The procedures of preparation for the thermal transfer recording medium in Example 1 were repeated to prepare a thermal transfer recording medium except for using a polyester resin having a hydroxyl value of 45 mgKOH/g in the ink layer.

Example 4

The procedures of preparation for the thermal transfer recording medium in Example 3 were repeated to prepare a thermal transfer recording medium except for using a polyethylene wax having a melting point of 110° C. and a penetration of 3.5 dmm instead of 96° C. and 6 in the separation layer.

Example 5

The procedures of preparation for the thermal transfer recording medium in Example 3 were repeated to prepare a thermal transfer recording medium except for using a polyethylene wax having a melting point of 113° C. and a penetration of 1.0 dmm instead of 96° C. and 6 in the separation layer.

Example 6

The procedures of preparation for the thermal transfer recording medium in Example 3 were repeated to prepare a thermal transfer recording medium except for using the following formulation to form a separation layer.

| | |
|---|---|
| Toluene dispersion liquid of a polyethylene wax having a melting point of 96° C. and a penetration of 6 dmm (a solid content of 10%) | 45 |
| Toluene liquid solution of a carnauba wax (a solid content of 10%) | 45 |
| Toluene liquid solution of an ethylene-vinylacetate copolymer resin (a solid content of 10%) | 10 |

Example 7

The procedures of preparation for the thermal transfer recording medium in Example 3 were repeated to prepare a thermal transfer recording medium except for using the following formulation to form a separation layer.

| | |
|---|---|
| Toluene dispersion liquid of a polyethylene wax having a melting point of 96° C. and a penetration of 6 dmm (a solid content of 10%) | 90 |
| MEK liquid solution of a polyester resin Vylon 200 from Toyobo Co., Ltd. (a solid content of 10%) | 10 |

Comparative Example 1

The procedures of preparation for the thermal transfer recording medium in Example 3 were repeated to prepare a thermal transfer recording medium except for using a polyester resin having a hydroxyl value of 18 mgKOH/g in the ink layer.

Comparative Example 2

The procedures of preparation for the thermal transfer recording medium in Example 3 were repeated to prepare a thermal transfer recording medium except that the separation layer was not formed.

Comparative Example 3

The procedures of preparation for the thermal transfer recording medium in Example 3 were repeated to prepare a thermal transfer recording medium except for using the following formulation to form a separation layer.

| | |
|---|---|
| Toluene liquid solution of a carnauba wax (a solid content of 10%) | 90 |
| Toluene liquid solution of an ethylene-vinylacetate copolymer resin (a solid content of 10%) | 10 |

Comparative Example 4

The procedures of preparation for the thermal transfer recording medium in Example 3 were repeated to prepare a thermal transfer recording medium except for using the following formulation to form an ink layer.

| | |
|---|---|
| MEK liquid solution of a polyester resin having a hydroxyl value of 25 mgKOH/g (a solid content of 20%) | 67 |
| MEK dispersion liquid of carbon black (a solid content of 20%) | 33 |

Comparative Example 5

The procedures of preparation for the thermal transfer recording medium in Example 3 were repeated to prepare a thermal transfer recording medium except for using the following formulation to form an ink layer.

| | |
|---|---|
| MEK liquid solution of a polyester resin having a hydroxyl value of 25 mgKOH/g (a solid content of 20%) | 60 |
| MEK dispersion liquid of an oxidized polyethylene having an acid value of 8 mgKOH/g (a solid content of 20%) | 7 |

Comparative Example 6

The procedures of preparation for the thermal transfer recording medium in Example 3 were repeated to prepare a thermal transfer recording medium except for using the following formulation to form an ink layer.

| | |
|---|---|
| MEK liquid solution of a polyester resin having a hydroxyl value of 65 mgKOH/g (a solid content of 20%) | 60 |
| MEK dispersion liquid of an oxidized polyethylene having an acid value of 5 mgKOH/g (a solid content of 20%) | 7 |
| MEK dispersion liquid of carbon black (a solid content of 20%) | 33 |

The thus prepared thermal transfer recording media of Examples 1 to 7 and Comparative Examples 1 to 6 were evaluated by the following test methods. As a receiving material, a self-adhesive white PET FR1415 manufactured by Lintec Corp. was used.

Printing Conditions

Printer: B-30 (flat type thermal head) from Toshiba Tec Corp.

Printing speed: 10 cm/sec

The following properties were evaluated.

1. Image Resolution

Transferred images printed with a standard application energy of the printer were evaluated by the following standards.

5: Images have a very sharp edge without a void and a thin spot

4: Images have a sharp edge without a void and a thin spot

3: Images have few voids and thin spots

2: Images have a slight void and a thin spot

1: Images have many voids and thin spots

2. Ethanol Resistance 0.5 cc of ethanol was painted on the transferred images and a rubbing test reciprocating for 30 times was performed thereon at a speed of 30 cm/sec under a 10 g/mm$^2$ load. The printed surface of the receiving material (white PET) was observed and the printed images were evaluated by the following standards.

5: Images are the same as those of before test
4: Images are readable but have slight scratches
3: Images are readable but have scratches
2: Images remain but are not readable
1: Images are rubbed out Example 8

The evaluations of the thermal transfer medium prepared in Example 3 were repeated except for using the following printing conditions:

Printer: B-474 (hedge type thermal head) from Toshiba Tec Corp.

Printing speed: 13 cm/sec

Comparative Example 7

The evaluations of the thermal transfer medium prepared in Example 8 were repeated except for using the thermal transfer medium prepared in Comparative Example 1.

The evaluation results are shown in Table 2.

TABLE 2

| | Image Resolution | Ethanol Resistance |
|---|---|---|
| Example 1 | 4 | 4 |
| Example 2 | 4 | 4 |
| Example 3 | 4 | 4 |
| Example 4 | 5 | 4 |
| Example 5 | 5 | 5 |
| Example 6 | 5 | 5 |
| Example 7 | 3 | 4 |
| Example 8 | 4 | 4 |
| Comparative Example 1 | 2 | 3 |
| Comparative Example 2 | 1 | 1 |
| Comparative Example 3 | 3 | 2 |
| Comparative Example 4 | 4 | 1 |
| Comparative Example 5 | 4 | 2 |
| Comparative Example 6 | 5 | 1 |
| Comparative Example 7 | 1 | 1 |

As Table 2 shows, the thermal transfer recording media of Examples 1 to 8 have not only good image resolution but also good ethanol resistance.

This document claims priority and contains subject matter related to Japanese Patent Application No. 2001-249694 filed on Aug. 20, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A thermal transfer recording medium comprising:

a substrate;

a separation layer located overlying the substrate; and an ink layer located overlying the separation layer, wherein the separation layer comprises:

a wax comprising a polyethylene wax, and wherein the ink layer comprises:

a thermoplastic saturated polyester resin having a hydroxyl value of from 20 to 60 mgKOH/g; and an oxidized polyethylene having an acid value not greater than 5 mgKOH/g.

2. The thermal transfer recording medium of claim 1, wherein the polyethylene wax has a melting point of from 100 to 120° C.

3. The thermal transfer recording medium of claim 1, wherein the polyethylene wax has a penetration less than 2 dmm at 25° C.

4. The thermal transfer recording medium of claim 1, wherein the polyethylene wax has a density not less than 0.94.

5. The thermal transfer recording medium of claim 1, wherein the separation layer further comprises a binder.

6. The thermal transfer recording medium of claim 5, wherein the binder is an ethylene-vinyl acetate copolymer resin.

7. The thermal transfer recording medium of claim 6, wherein the ethylene-vinyl acetate copolymer resin has a content of vinyl acetate units of from 15 to 35% by weight and a melt flow rate of from 10 to 200 dg/min.

8. The thermal transfer recording medium of claim 1, wherein the wax further comprises at least one member selected from the group consisting of carnauba wax and candelilla wax.

9. The thermal transfer recording medium of claim 8, wherein the wax is included in the separation layer in an amount not greater than 50% by weight based on total weight of the wax included therein.

10. The thermal transfer recording medium of claim 1, wherein the thermoplastic saturated polyester resin is a reaction product of a dicarboxylic acid compound with a glycol compound, and wherein the dicarboxylic acid compound comprises an aromatic dicarboxylic acid.

11. The thermal transfer recording medium of claim 1, wherein the thermoplastic saturated polyester resin has a glass transition temperature of from 10 to 55° C. and a number-average molecular weight of from 500 to 6,000.

12. The thermal transfer recording medium of claim 1, wherein the thermoplastic saturated polyester resin is included in the ink layer in an amount of from 40 to 80% by weight based on total weight thereof.

13. The thermal transfer recording medium of claim 1, wherein the oxidized polyethylene is a particulate substance having a particle diameter of from 0.1 to 10 $\mu$m.

14. The thermal transfer recording medium of claim 1, wherein the oxidized polyethylene is included in the ink layer in an amount of from 5 to 15% by weight based on total weight thereof.

15. The thermal transfer recording medium of claim 1, wherein the separation layer has a thickness of from 0.2 to 3.0 $\mu$m.

16. The thermal transfer recording medium of claim 1, wherein the ink layer has a thickness of from 0.5 to 6.0 $\mu$m.

17. The thermal transfer recording medium of claim 1, further comprising a protection layer, wherein the protection layer is located on an opposite side of the substrate to a side thereof on which the separation layer and the ink layer are located.

* * * * *